US011465432B2

(12) United States Patent
Merrick

(10) Patent No.: US 11,465,432 B2
(45) Date of Patent: Oct. 11, 2022

(54) UPSIDE DOWN BOOK

(71) Applicant: Jon Merrick, Fredericksburg, TX (US)

(72) Inventor: Jon Merrick, Fredericksburg, TX (US)

( * ) Notice: Subject to any disclaimer, the term of this patent is extended or adjusted under 35 U.S.C. 154(b) by 0 days.

(21) Appl. No.: 17/355,110

(22) Filed: Jun. 22, 2021

(65) Prior Publication Data

US 2022/0041002 A1 Feb. 10, 2022

Related U.S. Application Data

(60) Provisional application No. 63/043,022, filed on Jun. 23, 2020.

(51) Int. Cl.

| | |
|---|---|
| ***B42D 25/00*** | (2014.01) |
| ***B42D 3/08*** | (2006.01) |
| ***B42D 1/00*** | (2006.01) |

(52) U.S. Cl.

CPC ..... *B42D 3/08* (2013.01); *B42D 1/00* (2013.01); *B42D 1/009* (2013.01)

(58) Field of Classification Search

CPC ..... B42D 1/00; B42D 1/009

See application file for complete search history.

(56) References Cited

U.S. PATENT DOCUMENTS

| | | | | |
|---|---|---|---|---|
| 1,353,371 | A * | 9/1920 | Winslow | B42D 1/009 283/63.1 |
| 2,544,568 | A | 3/1951 | Shepherd | |
| 4,606,554 | A * | 8/1986 | Lederman | B42F 11/00 273/284 |
| 4,932,679 | A | 6/1990 | Mayer et al. | |
| 5,626,365 | A | 5/1997 | Petteway | |
| 5,713,743 | A | 2/1998 | Clements | |
| 6,210,172 | B1 * | 4/2001 | Clements | B42D 1/00 434/428 |
| 6,454,307 | B1 | 9/2002 | Polick | |
| 6,932,609 | B1 | 8/2005 | Bozek | |
| 8,272,154 | B2 | 9/2012 | Sapp et al. | |
| 8,353,536 | B2 | 1/2013 | Andres | |
| 8,801,042 | B1 | 8/2014 | Lyver | |
| 2004/0217584 | A1 * | 11/2004 | Holms | B42D 1/00 281/15.1 |
| 2006/0022448 | A1 * | 2/2006 | Bolton | B42D 1/001 281/15.1 |
| 2007/0278782 | A1 | 12/2007 | Karkkainen | |
| 2009/0230668 | A1 * | 9/2009 | Andres | B42D 1/009 281/16 |
| 2012/0164610 | A1 | 6/2012 | Pascale | |
| 2015/0166296 | A1 | 6/2015 | Witkowski | |
| 2016/0325576 | A1 * | 11/2016 | Clements | B42F 7/065 |

OTHER PUBLICATIONS

Upside-Down World https://www.youtube.com/watch?v=bESwPTldglQ (Year: 2014).*

* cited by examiner

*Primary Examiner* — Kyle R Grabowski
(74) *Attorney, Agent, or Firm* — Scheinberg & Associates, PC; Michael Scheinberg

(57) ABSTRACT

A children's book includes pages having text in a first orientation and pages in a second orientation, the first and second orientation related by being upside down relative to each other. As a child reads the book from a first end, the child encounters up a page with writing in both orientations, instructing him to turn the book upside down, close, and re-open the book. As the child re-opens the book that was turned upside down, the story continues from the opposite end of the book.

9 Claims, 15 Drawing Sheets

*A Christmas Tail*

*The Beginning Of the End*

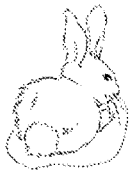

An Upside-Down Book
By
Jon Merrick
jawnTEM
Papa jawn
Or just Papa

1110

1111

This Story;
Is dedicated to all my
Grandchildren,
Great Grandchildren!
&
To Children of All Ages,
The World Over There is a special "Magic" in sharing meaningful things with others
The more meaning & the more sharing,
The more Magic there is.

For Children of all ages,
Christmas & the Holidays carries a special Magic all it's own, In the tradition of the original "Night Before Christmas",
"A Christmas Tail", wasn't created as a standalone Story;
(Although, it certainly be enjoyed as such),
It is really meant to be shared by being read & enjoyed by all.

Whether the reading is by a parent, or a child,
It is truly meant for a "Holliday Togetherness"!

What better time for such Love & Magic,
Than at Christmas time!

Merry Christmas!
One and All!

1112

Christmas Tail
The beginning of the end!

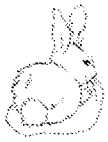

And so, we mysteriously begin our tale,
Not at the beginning of our story but, rather at the end.
On the Eve of Christmas!

1113

T'was the Night Before Christmas

And all Through the House,

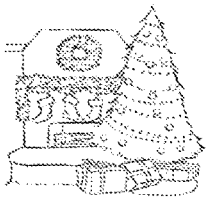

Not a Creature Was Stirring

Except for a .....,

1114

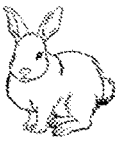

Wait! A Bunny?
That's not how the story goes is it?
How is it supposed to go?
Right, a Mouse!
It's supposed to say,
"Not a creature was stirring,
Not even a Mouse!
But it says a creature was stirring.
And it's a Bunny?

1115

And look! This Bunny's upside down!

How curiously strange!
What does this say I wonder!
Let's read it, shall we?

In-struc-ions:
Turn the Bunny Right-side up.

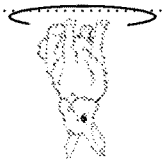

Now Close the book,
&
Open it to the first page!

1116

*The End!*

*Merry Christmas to All*

*And To All, A Good Night*

1117

*The End!*

*Merry Christmas to All*

*And To All, A Good Night*

1118

FIG. 11

1125 1126 1127 1123 1124 1122 1120 1121 1119

FIG. 12

FIG. 13

UPSIDE DOWN BOOK

TECHNICAL FIELD OF THE INVENTION

The present invention relates to books, and in particular, to books for children

BACKGROUND OF THE INVENTION

There are many book formats that are designed to appeal to children. U.S. Pat. No. 4,606,554 for a "Topsy-Turvy Book" describes a children's book in which every other page is inverted. This allows for two children, one on either side of a desk, to read or color in the book at the same time. U.S. Pat. No. 2,544,568 to Shepard for "Reversible Book" describes a book that includes two different stories. The pages are constructed from a single sheet with accordion folds, bound on the edges, and the binding can slide from one side of the book to the other side, exposing a different story in the accordion fold. Similarly, U.S. Pat. No. 4,932, 679 for "Children's Books" describes a book that has detachable binding on both sides with accordion folds, so that the book can be opened from either exposing a different side of the accordion folded pages. U.S. Pat. No. 1,353,371 to Winslow for a "Page Arrangements for Book" described a book format in which e very other page is inverted. Winslow asserts that this makes the book easier to read by not requiring the reader to change position of his head and neck.

SUMMARY OF THE INVENTION

An object of the invention is to provide a children's book and a method of making an using a children's book.

Portions of the book have a writing in a first orientation and portions have writing in a second orientation, that is "upside down" relative to the first orientation. A reader begins reading a book from a first direction and part way through, is instructed to flip the book over, close the book, and reopen it. The reader continues reading the re-opened book from a second direction opposite to the first direction, until the story ends in the interior of the book, before the last page read in the first orientation.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which:

FIGS. 11-14 shows the pages of a book in the order presented as pages as turned from one end to the other.

DETAILED DESCRIPTION OF PREFERRED EMBODIMENTS

Figure 1:
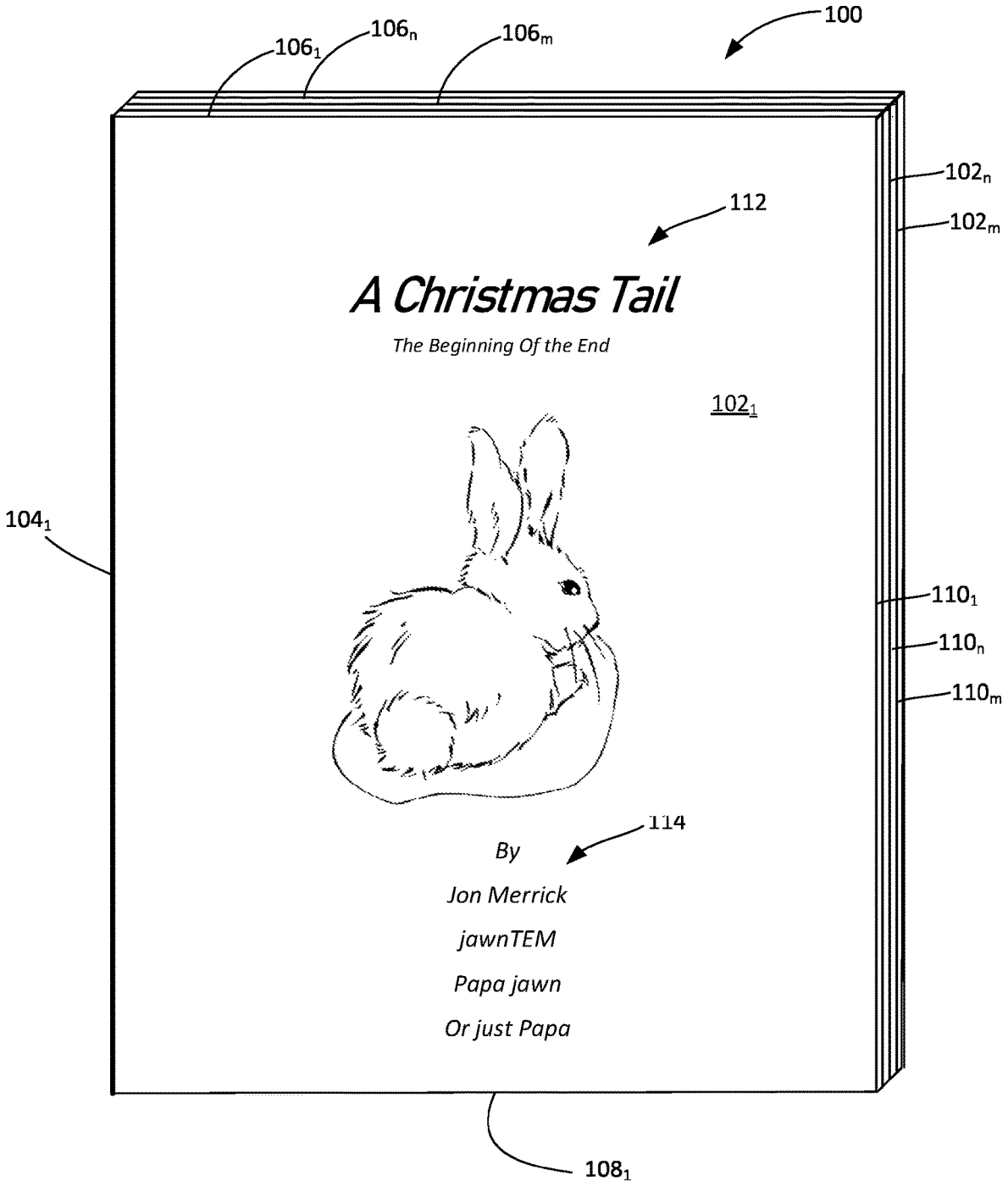
FIGS. 1-10 shows pages of a book.

A preferred embodiment of the invention uses a book in which some of the pages are inverted relative to other pages FIG. 1 shows a children's book 100 having a first page $\mathbf{102}_1$. First page $\mathbf{102}_1$ may be a cover page, such as a hard cover or a soft cover, or may an inside page. First page $\mathbf{102}_1$ includes a first edge $\mathbf{104}_1$, a second edge $\mathbf{106}_1$, a third edge $\mathbf{108}_1$ and a fourth edge $\mathbf{110}_1$. First page $\mathbf{102}_1$ typically includes a title 112 and author information 114. As shown in FIG. 1, first edge $\mathbf{104}_1$ is initially oriented on a reader's left and second edge $\mathbf{106}_1$ is oriented at the top of the book edge, with third edge $\mathbf{106}_1$ oriented at the bottom 102.

As can be seen in FIG. 1, book 100 comprises multiple pages such as pages $\mathbf{102}_1, \ldots \mathbf{102}_n \ldots \mathbf{102}_m \ldots$, in which a book has "m" total pages and the pages and corresponding edges are designed with subscripts from 1 to "m," with the subscript "n" representing any page in the book. Each page $\mathbf{102}_n$ has an associated first edge $\mathbf{104}_n$, second edge $\mathbf{104}_n$, third edge $\mathbf{106}_n$, and fourth edge $\mathbf{106}_n$. Pages $\mathbf{102}_1$ to $\mathbf{102}_m$ are bound together on their respective first edges $\mathbf{104}_1$ to $\mathbf{104}_m$. As will be clear later in the disclosure, the last page to be read is not physically the last page in the book when viewed as shown as shown in FIG. 1. That is, page $\mathbf{102}_m$, which is the last page of the story, is not the physical last page of the book by the rear cover. The reader reads part of the story from one cover toward the center, flips the book upside down, and then finishes the story by reading from the other cover toward the center, ending in the interior of the book.

Figure 2:
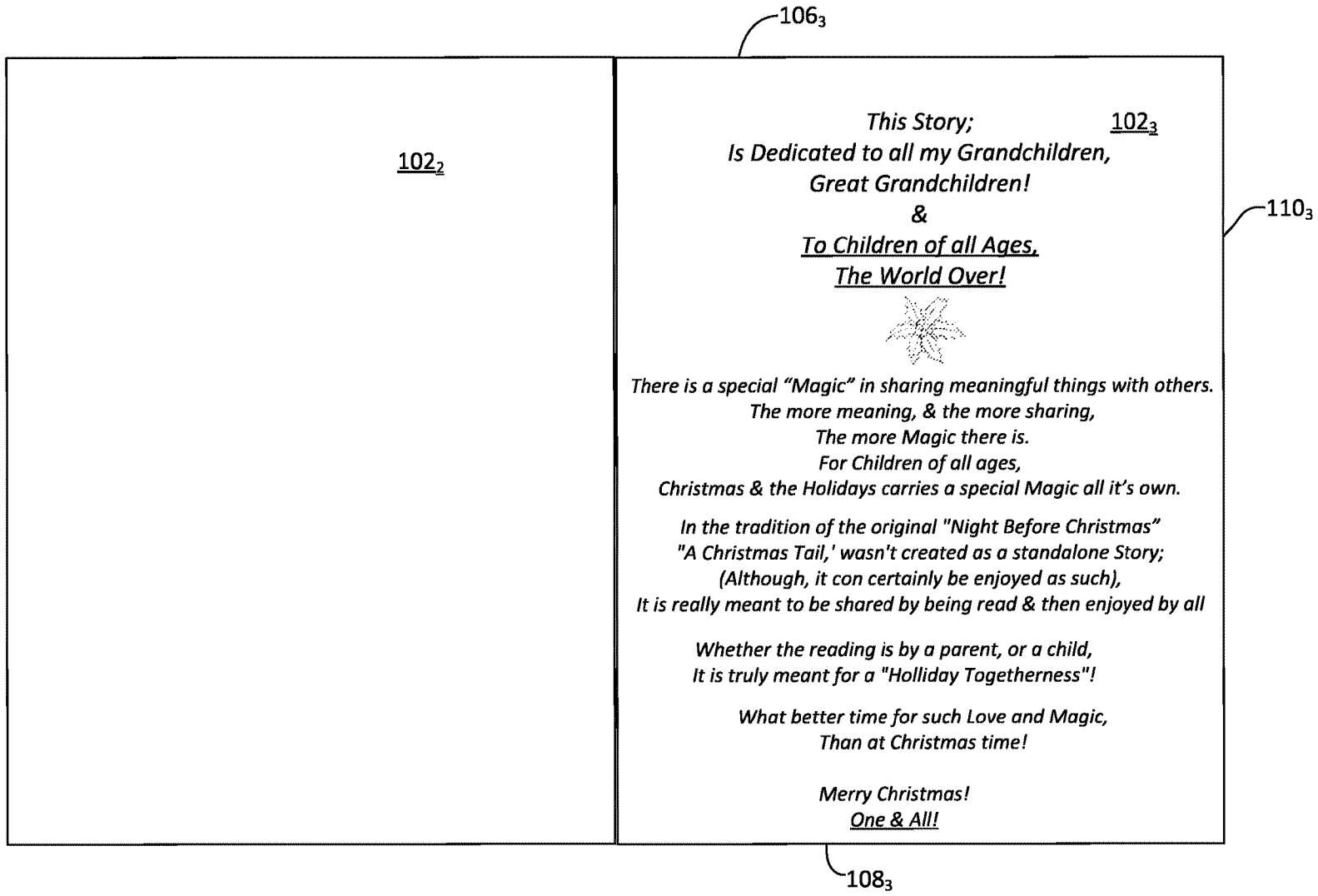
Figure 3:
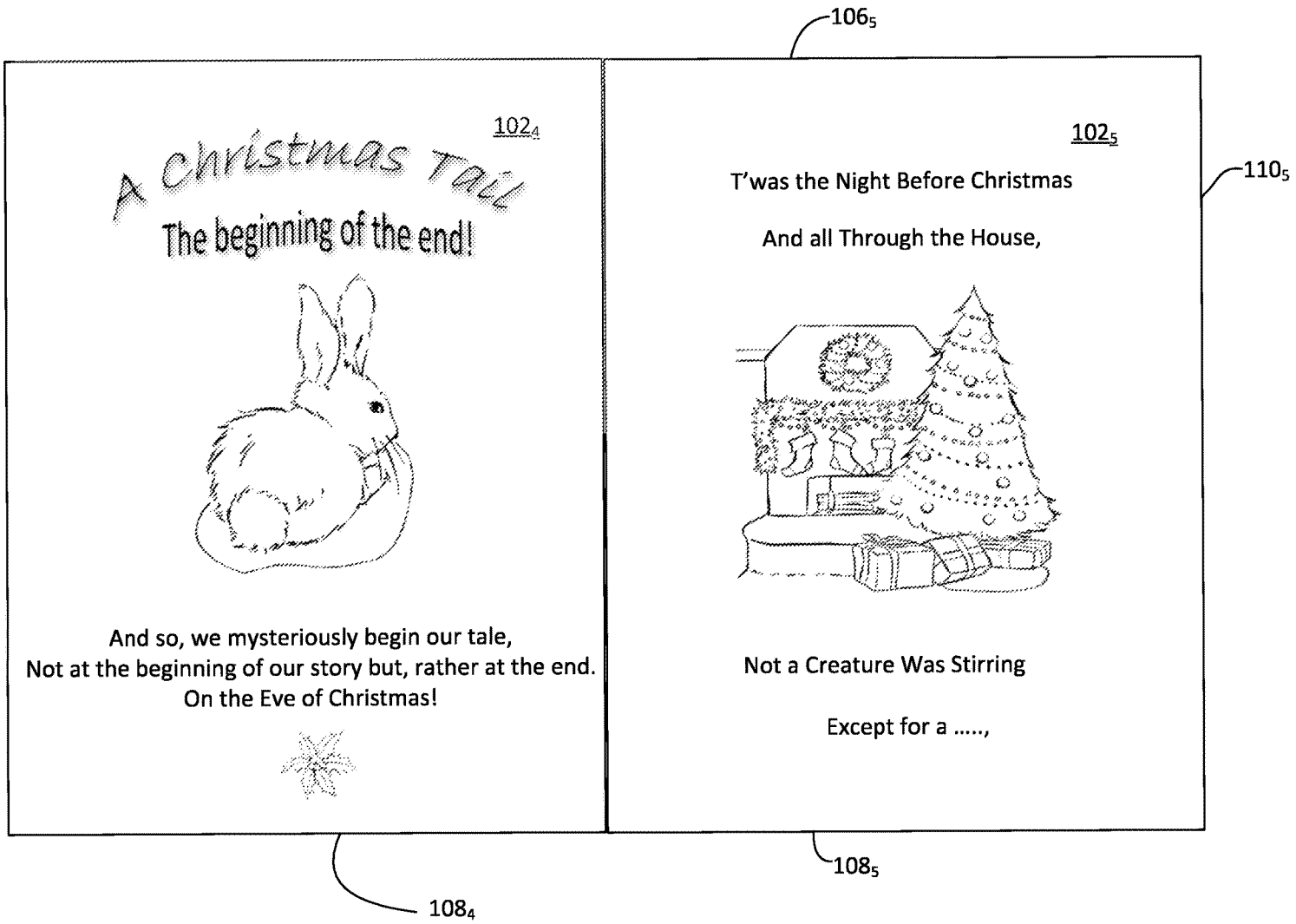

A child reading the book opens the book in the normal way by rotating right edge $\mathbf{110}_1$ from the right to the left, which exposes page $\mathbf{102}_2$ on the left and $\mathbf{102}_3$ on the right as shown in FIG. 2. In this example, page $\mathbf{102}_2$ happens to be blank. After reading $\mathbf{102}_2$ and $\mathbf{102}_3$, the reader rotates fourth edge $\mathbf{110}_3$ from right to left and exposing pages $\mathbf{102}_4$ and $\mathbf{102}_5$ as shown in FIG. 3. After reading $\mathbf{102}_4$ and $\mathbf{102}_5$, the reader rotates fourth edge $\mathbf{110}_5$ from right to left and exposing pages $\mathbf{102}_6$ and $\mathbf{102}_7$ as shown in FIG. 4.

Figure 4:
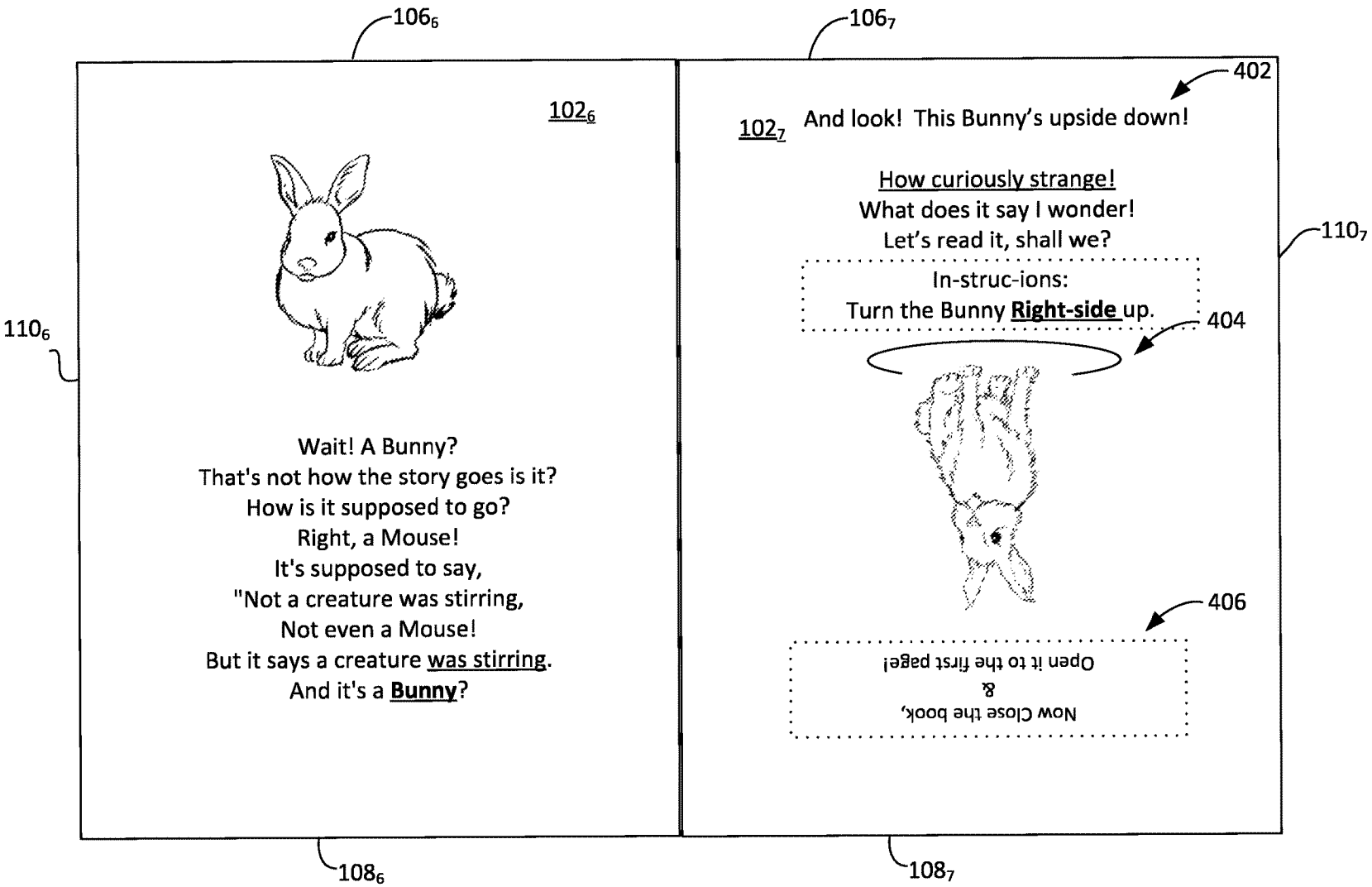
Figure 5:
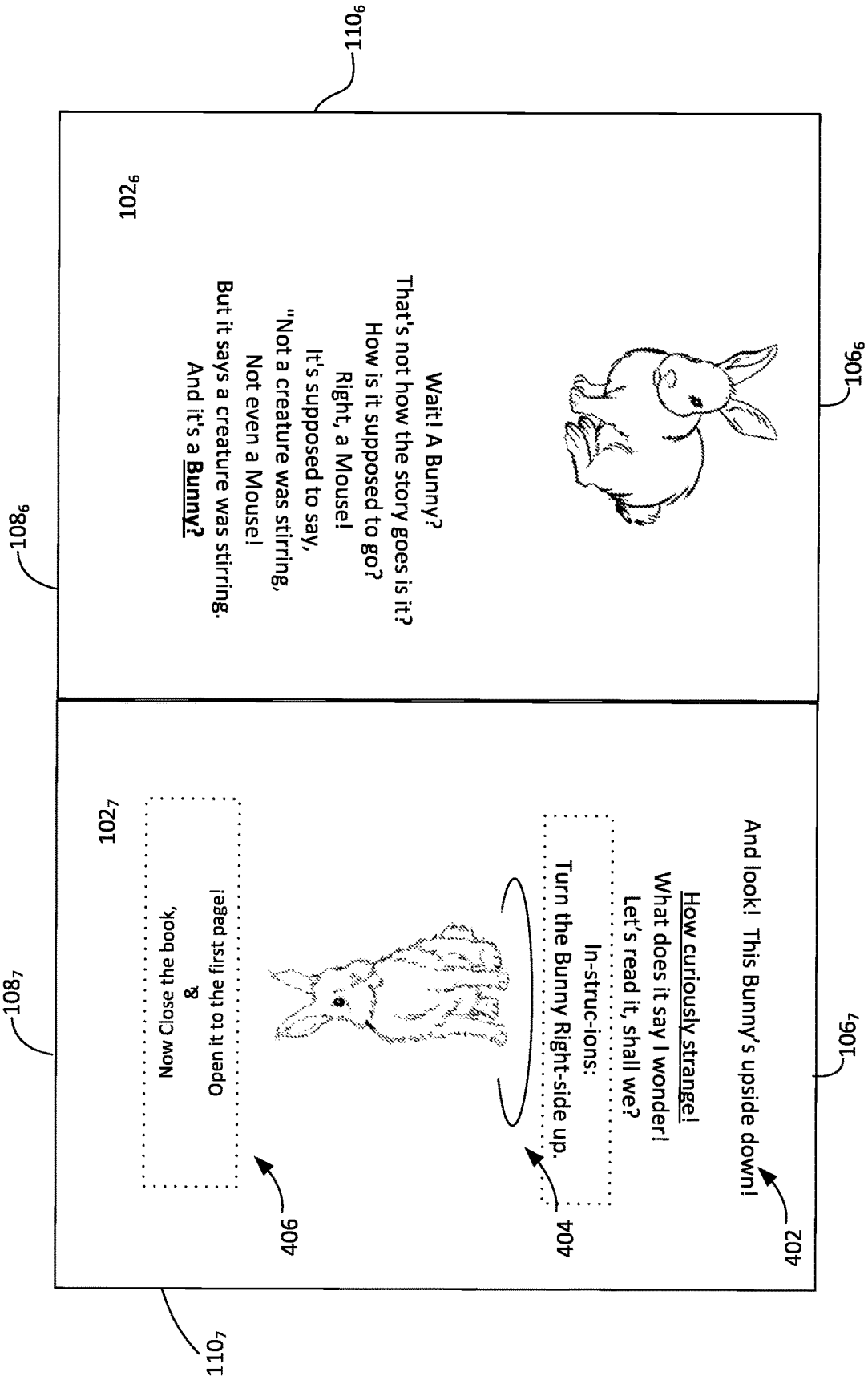

As shown in FIG. 4, page $\mathbf{102}_7$ includes text 402 that is oriented right side up and a picture 404 and/or text 406 that is oriented upside down. The text 402 instructs the reader to turn the book upside down to view the picture 404 and/or read the text 406. Upon turning the book upside down, as shown in FIG. 5, the reader finds that text 406 tell the reader to close the book and open the book to the first page.

When the reader turns the book upside down to view picture 404 and/or read text 406, the binding on the first edges is now of the right side of page $\mathbf{102}_7$ and edge $\mathbf{106}_7$ is now on the bottom and edge $\mathbf{108}_7$ is now on the top. The reader closes the book as instructed, by rotating the left edge of the book, that is, the edge of the book corresponding to corresponding to edge $\mathbf{110}_7$ of page $\mathbf{102}_7$, from left to right. The second cover is now to the right of the binding and as the book reopens it to the first page, the first page is now on the opposite end of the book from the original first page when the reader originally started reading the book. The book is now oriented as shown in FIG. 6, with the binding on the left and displaying a second cover or page $\mathbf{102}_8$.

Figure 6:
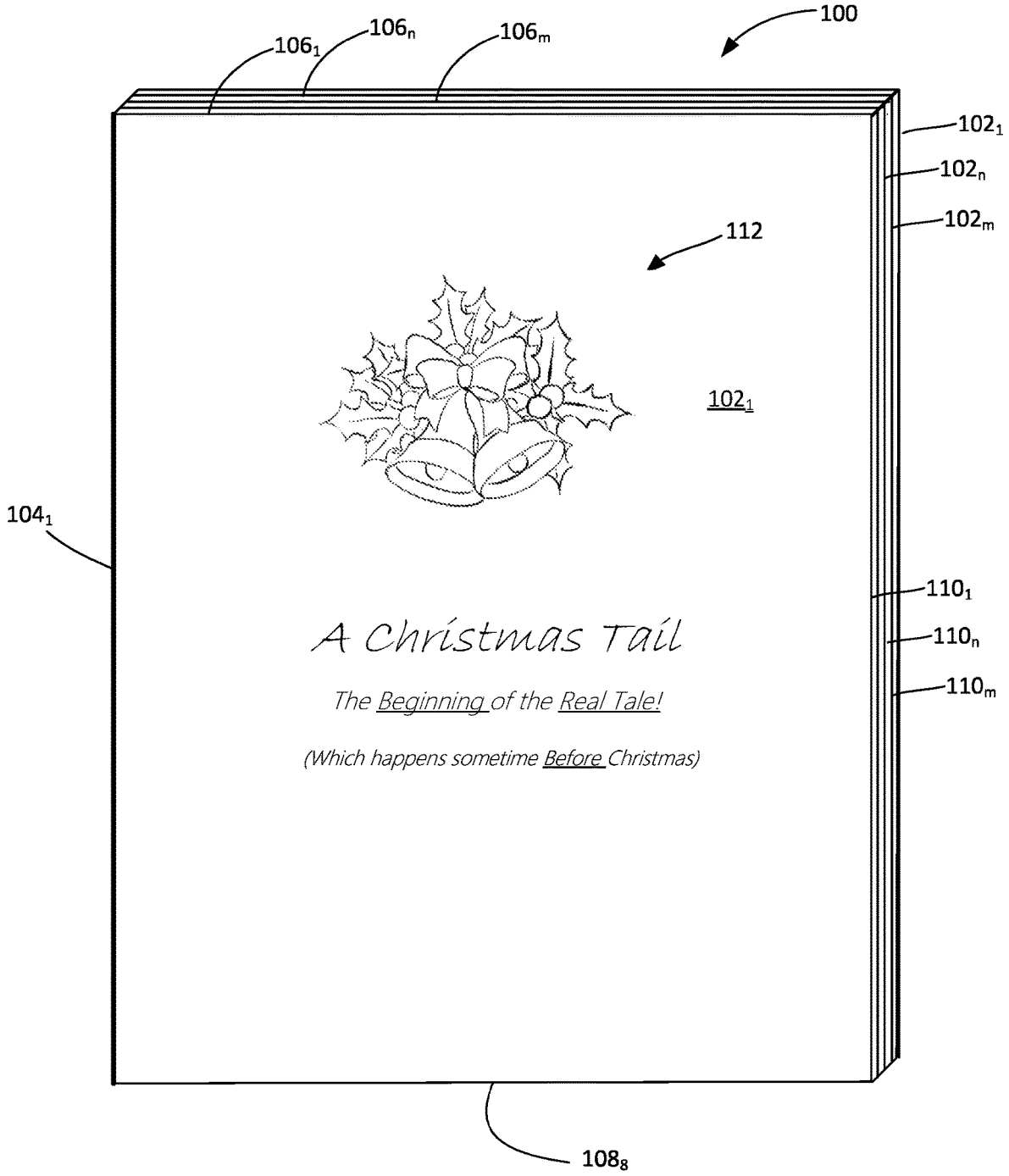
Figure 7:
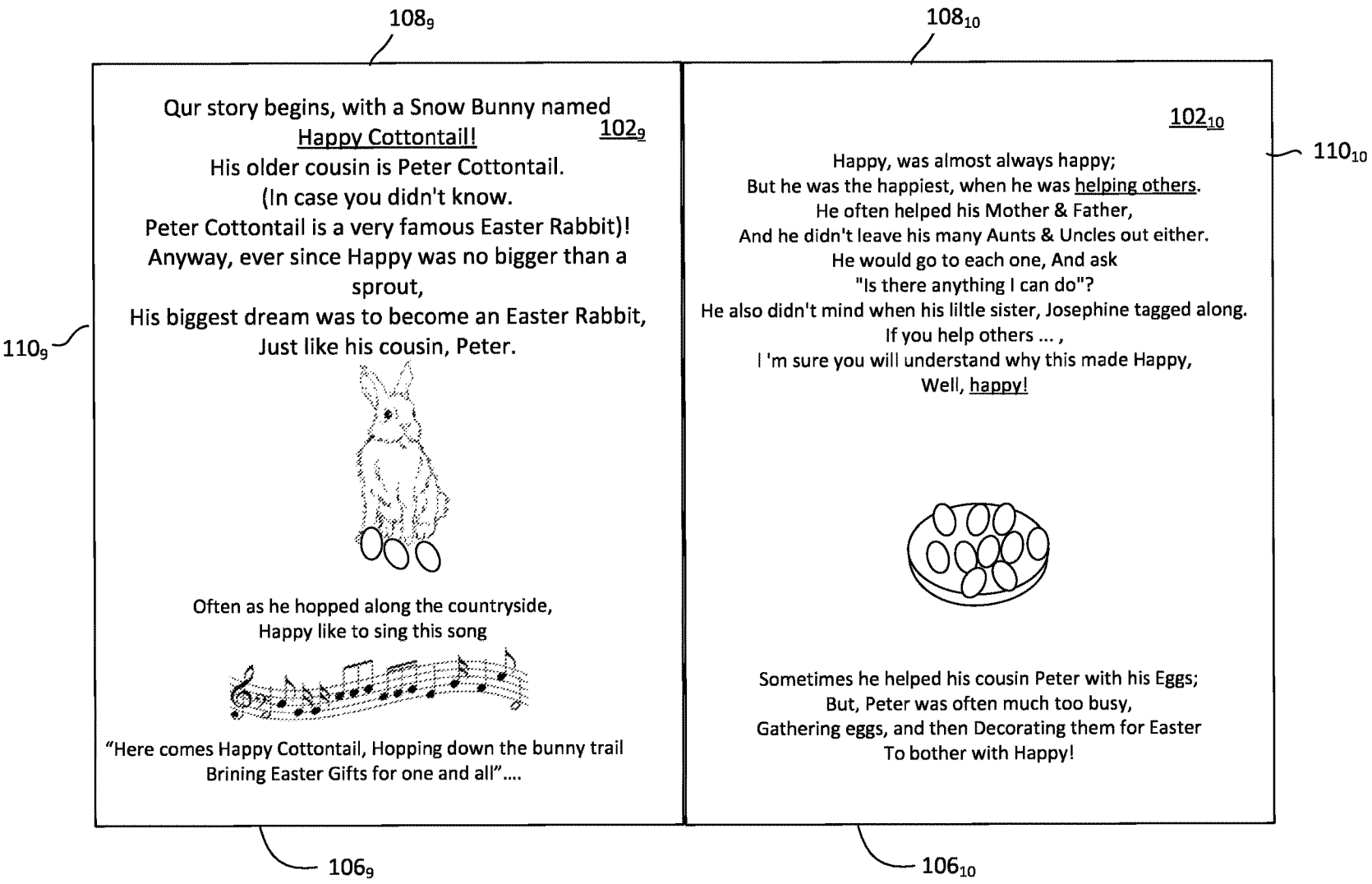

As shown in FIG. 6, page $\mathbf{102}_1$ is now at the back of the book. As the book is opened by rotating edge $\mathbf{110}_8$ from the left to the right, pages $\mathbf{102}_9$ and $\mathbf{102}_{10}$ are exposed as shown in FIG. 7.

Figure 8:
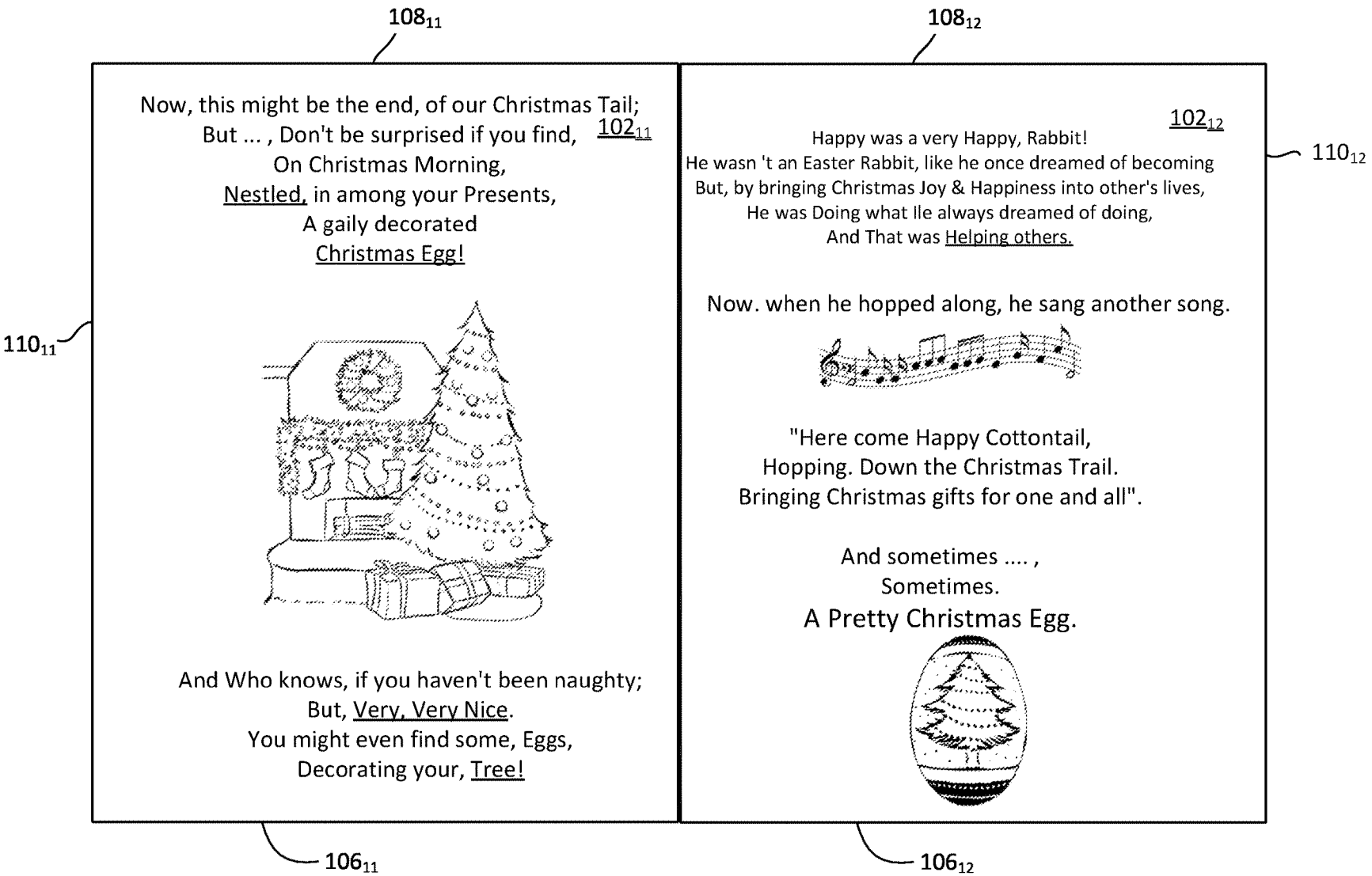
Figure 9:
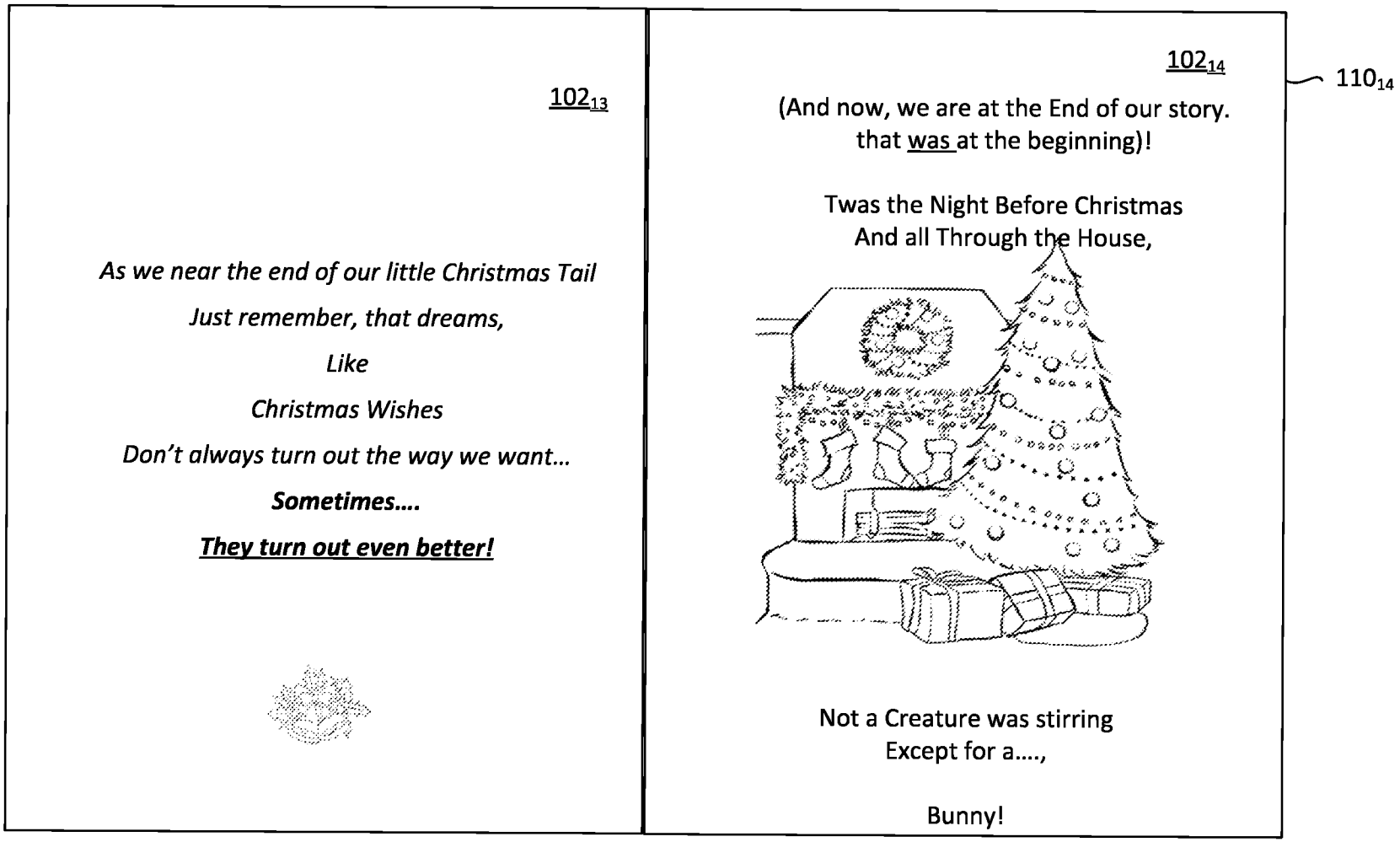
Figure 10:
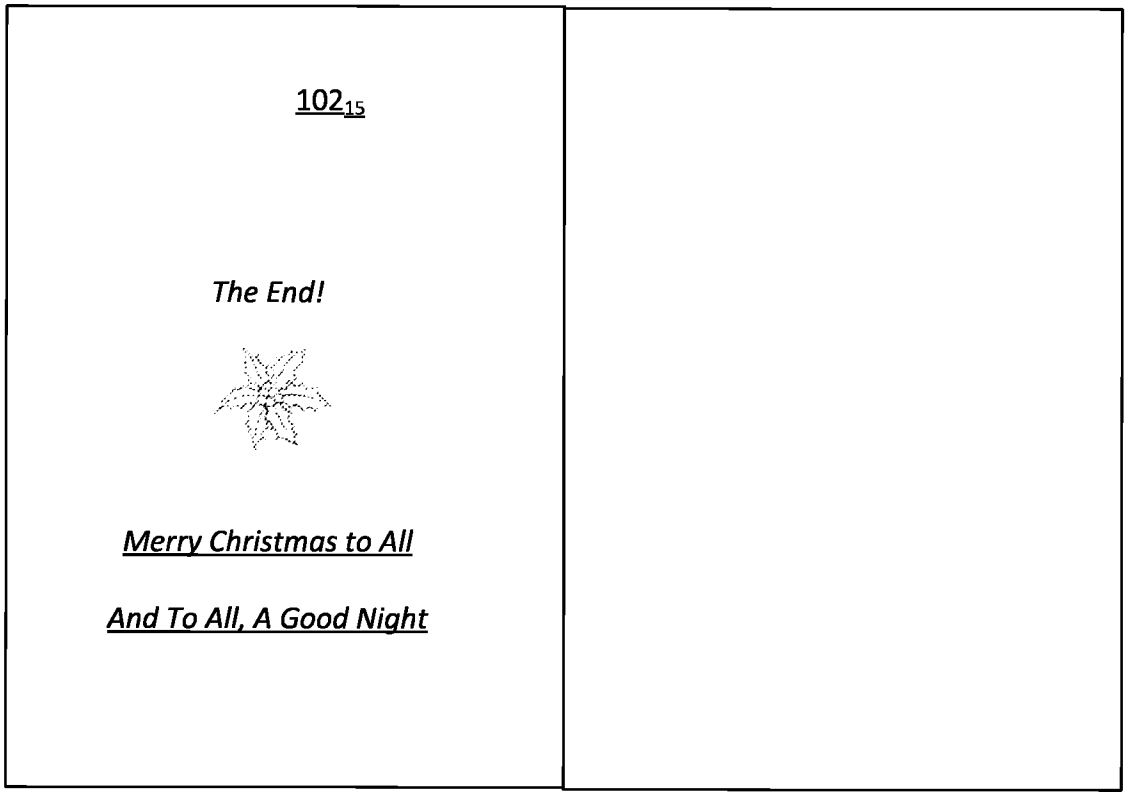
Figure 14:
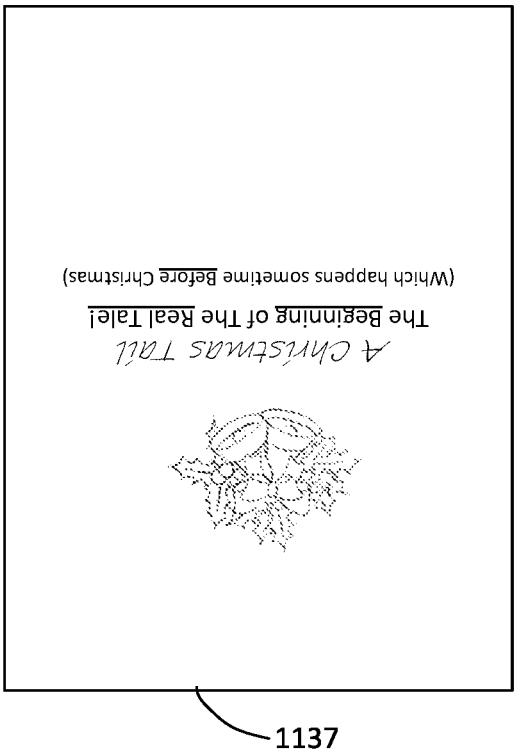

The reader continues reading in the normal manner, turning the right side edge of the page to the left to turn the page. FIG. 8 shows the two pages, $\mathbf{102}_{11}$ and $\mathbf{102}_{12}$ to be read after pages $\mathbf{102}_{9}$ and $\mathbf{102}_{10}$ of FIG. 7. The reader continues reading in the normal manner, turning the right side edge $\mathbf{110}_{12}$ of page $\mathbf{102}_{12}$ to the left to expose pages $\mathbf{102}_{13}$ and $\mathbf{102}_{14}$ as shown in FIG. 9. The reader continues reading in the normal manner, turning the right side edge $\mathbf{110}_{14}$ of page $\mathbf{102}_{14}$ to the left to expose pages $\mathbf{102}_{15}$ and $\mathbf{102}_{16}$ as shown in FIG. 10. Page $\mathbf{102}_{15}$ is the last page of the story, and page $\mathbf{102}_{16}$ is a blank page. In other embodiments, page $\mathbf{102}_{16}$ could be the last page of the story. Page $\mathbf{102}_{15}$, the last page of the story, is not the last physical page of the book. Having finished the story, the reader can now close the book. If a reader were to continue to turn page $\mathbf{102}_{16}$, turning the page would expose pages $\mathbf{102}_{6}$ and $\mathbf{102}_{7}$ as shown in FIG. 5, in the orientation shown in FIG. 5. Turning the page again would expose pages $\mathbf{102}_{4}$ and $\mathbf{102}_{5}$, which would be oriented upside down.

As described above, the last reading page of $\mathbf{100}_{m}$ is positioned not at the front or the rear of the book, but in the interior of the book. A reader begins reading the book from a first direction and when instructed, flips the book over and begin reading from the other direction. Whenever the book read, the binding is positioned on the left. When the reader begins reading the book, a first edge is positioned at the top. At some point, the reader is instructed to turn the book upside down, and with the first edge now at the bottom and the binding on the left, the reader opens the book from the opposite direction. The writing is now oriented upside down to the writing in the original direction. Eventually, the reader would encounter pages he already read from the other direction. Before that happens, the story is concluded.

FIGS. 11-14 show all the pages in sequence when a reader opens the book in the orientation shown in FIG. 1 and turns the pages, disregarding instructions to turn the book upside down and open from the opposite side and re-open the book.

Figure 15:
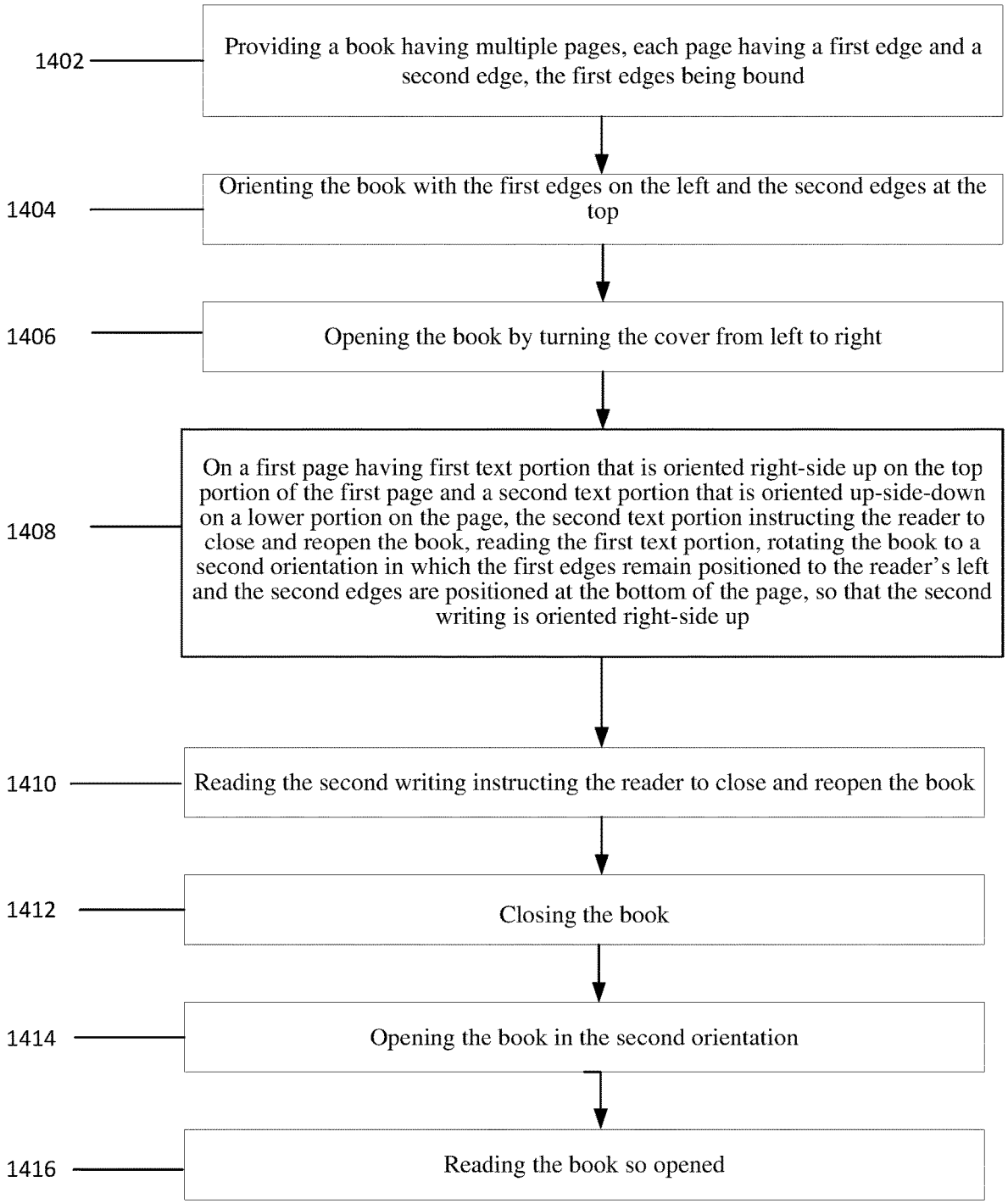
FIG. 15 is a flowchart showing the steps of reading a book as described herein.

FIG. 15 is a flowchart showing a method of reading a book. Step 1402 entails providing a book having multiple pages, each page having a first edge and a second edge, the first edges being bound. Step 1404 entails orienting the book with the first edges on the left and the second edges at the top. Step 1406 entails opening the book by turning the cover from left to right. Step 1408 entails, on a first page having first text portion that is oriented right-side up on the top portion of the first page and a second text portion that is oriented up-side-down on a lower portion on the page, the second text portion instructing the reader to close and reopen the book, reading the first text portion, rotating the book to a second orientation in which the first edges remain positioned to the reader's left and the second edges are positioned at the bottom of the page, so that the second writing is oriented right-side up. Step 1410 entails reading the second writing instructing the reader to close and reopen the book. Step 1412 entails closing the book. Step 1414 entails opening the book in the second orientation. Step 1416 entails reading the book so opened.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

I claim:

1. A children's book comprising:

multiple pages, each page having a first edge and a second edge;

a binding holding the pages together on the first edges;

one and only one of the multiple pages having a first text portion positioned on an upper portion of a page and a second text portion positioned on a lower portion of the page, in which:

the first text portion oriented in an upright orientation when the book is oriented in a first orientation with the first edge to the reader's left and the second edge at the top;

the second text portion oriented in an up-side down direction when the book is oriented in the first orientation, the second text portion including instructions to close and re-open the book; and at least a second one of the multiple pages having a text portion oriented in an upright orientation when the book is oriented in a second orientation in which the second edge is positioned at the bottom of the page and the first edge is positioned to the reader's left.

2. The children's book of claim 1 in which the multiple pages include at least two pages prior to the said one and only one of the multiple pages and the at least a second page comprises at least two second pages.

3. The children's book of claim 1 further comprising a front cover.

4. A method of reading a children's book, ;

providing a book having multiple pages, each page having a first edge and a second edge, the first edges being bound;

orienting the book with the first edges on the left and the second edges at the top;

opening the book by turning the cover from left to right to a first page having writing in only a single first orientation;

turning the pages to a second page, the second page having first text portion that is oriented right-side up on the top portion of the first page and a second text portion that is oriented up-side-down on a lower portion on the page, the second text portion instructing the reader to close and reopen the book, reading the first text portion;

rotating the book to a second orientation in which the first edges remain positioned to the reader's left and the second edges are positioned at the bottom of the page, so that the second writing is oriented right-side up;

reading the second writing instructing the reader to close and reopen the book;

closing the book;

opening the book in the second orientation to a third page including writing in only a single second orientation opposite to the first orientation; and reading the book so opened.

5. The method of claim 4 in which reading the book so opened comprises reading at least two pages.

6. The method of claim 4 in which reading the book so opened comprises reading the book so opened until coming to a page indicating that the book has concluded.

7. The method of claim 4 in which reading at least one page comprises reading at least two pages.

8. A children's book, comprising:

multiple pages with the writing oriented only in a first direction so that a reader opens the book from left to right with a first edge of the book at the top of the book, the writing is right side up;

multiple pages with the writing oriented only in a second direction so that when a reader opens the book from left to right with a first edge of the bottom of the book, the writing is right side up;

a flip page having writing in the first direction and writing in the second direction, the writing in the first direction instructing the reader to turn the book upside down so that the writing in the second direction can be read and to close the book and reopen it from the opposite side, the writing in the first direction and in the second direction comprising different parts of the same story, the story beginning on pages having the first orientation and ending on pages of the second orientation, the last page of the story being in the interior of the book.

9. The book of claim 8 in which the last page of the story is the page is just prior to the page having writing in the first direction and writing in the second direction, that is, if the reader were to turn the page after the last page of the story, the reader would see the flip page.

* * * * *